US011738900B2

(12) United States Patent
Moneypenny et al.

(10) Patent No.: US 11,738,900 B2
(45) Date of Patent: Aug. 29, 2023

(54) CONFIGURABLE UNIVERSAL BAG HOLDER

(71) Applicant: Walmart Apollo, LLC, Bentonville, AR (US)

(72) Inventors: Dewayne Moneypenny, Bentonville, AR (US); Alexander Micheal Alvarado, Bentonville, AR (US)

(73) Assignee: Walmart Apollo, LLC, Bentonville, AR (US)

( * ) Notice: Subject to any disclaimer, the term of this patent is extended or adjusted under 35 U.S.C. 154(b) by 0 days.

(21) Appl. No.: 17/378,704

(22) Filed: Jul. 17, 2021

(65) Prior Publication Data

US 2023/0019798 A1 Jan. 19, 2023

(51) Int. Cl.

| | |
|---|---|
| ***B65B 67/12*** | (2006.01) |
| ***A47F 9/04*** | (2006.01) |
| ***A47F 13/08*** | (2006.01) |

(52) U.S. Cl.

CPC ..... *B65B 67/1227* (2013.01); *A47F 9/04* (2013.01); *A47F 13/085* (2013.01); *A47F 2009/041* (2013.01)

(58) Field of Classification Search

CPC ..... B65B 67/1227; A47F 9/04; A47F 13/085; A47F 2009/041

See application file for complete search history.

(56) References Cited

U.S. PATENT DOCUMENTS

| | | | | |
|---|---|---|---|---|
| 3,747,298 | A * | 7/1973 | Lieberman | B65B 67/1266 53/384.1 |
| 4,458,867 | A * | 7/1984 | Malik | B65B 67/1205 248/97 |
| 4,723,743 | A * | 2/1988 | Jenkins | B65B 67/12 220/9.4 |
| 5,042,687 | A * | 8/1991 | McKinley | A47G 29/00 221/45 |
| 5,465,846 | A | 11/1995 | Blyth et al. | |
| 6,402,098 | B2 * | 6/2002 | Rosky | B65B 67/1227 53/390 |

(Continued)

OTHER PUBLICATIONS

Unknown, "Over The Cabinet Grocery Bag Holder Basket Garbage Bag Holder Chrome", Amazon, https://www. amazon.in/Cabinet-Grocery-Holder-Basket-Garbage/dp/B084YY3LQ8, captured May 28, 2021, 3 pages.

*Primary Examiner* — Kimberly T Wood
(74) *Attorney, Agent, or Firm* — Barta, Jones & Foley, PLLC

(57) ABSTRACT

Examples provide a universal bag holder for storing multiple different types of bags on a single bag holder device. The bag holder includes a bag receptacle for holding folded paper bags or folded reusable bags, such as cloth bags. An access window in one side of the receptacle enables a user to retrieve items which may fall into the receptacle. The bag holder also includes a bag support rack having a set of bag support arms for supporting plastic bags or reusable bags on the arms. The loops on the plastic or reusable bags are placed over the bag support arms. A paper bag that has been unfolded can also be supported between the bag support arms. A label holder permits placement of price tags or other information labels for the bags. The bag holder can be attached to pre-existing bagging area fixtures for ease of use.

19 Claims, 16 Drawing Sheets

(56) References Cited

U.S. PATENT DOCUMENTS

| | | | | |
|---|---|---|---|---|
| 8,496,134 | B2 * | 7/2013 | Springer | B65D 83/0805 221/92 |
| 10,028,597 | B2 | 7/2018 | Bacallao | |
| 10,610,032 | B2 | 4/2020 | Bacallao et al. | |
| 2004/0112850 | A1 * | 6/2004 | Jordan | A47G 29/00 211/88.01 |
| 2005/0178736 | A1 * | 8/2005 | Wilfong | B65D 83/08 211/59.1 |
| 2011/0266092 | A1 | 11/2011 | Marquis | |
| 2014/0138499 | A1 * | 5/2014 | Laitila | B65B 67/1227 248/97 |
| 2017/0055727 | A1 * | 3/2017 | Tan | B65D 33/001 |
| 2017/0354274 | A1 * | 12/2017 | Bacallao | A47F 9/042 |
| 2018/0065770 | A1 * | 3/2018 | Bacallao | B65B 67/1266 |
| 2018/0170597 | A1 * | 6/2018 | Bacallao | B65B 51/043 |
| 2019/0127103 | A1 * | 5/2019 | Bacallao | B65B 67/1233 |
| 2019/0357704 | A1 * | 11/2019 | Bacallao | F16B 1/00 |
| 2019/0357705 | A1 * | 11/2019 | Bacallao | A47B 49/00 |

* cited by examiner

CONFIGURABLE UNIVERSAL BAG HOLDER

BACKGROUND

When purchasing items at a checkout, a user frequently requires one or more bags or other containers to store the purchased items. The items are typically bagged at a bagging station using paper bags, plastic bags, cloth bags and/or cardboard boxes. Each of these types of containers are typically stored or made available on a separate bag holding device. For example, plastic bags are frequently made available hanging on two metal or plastic arms on a bagging rack or bag carrousel. Paper bags are frequently presented in a folded configuration laying on a shelf or placed in a box. Cloth bags may be provided on hooks, shelves or other bag holders configured for cloth bags. These disparate bag holders are frequently incompatible with each other, necessitating a user to choose which type of bag to provide while excluding other types. Likewise, once a specific type of bag holder has been installed, such as a bag holder for plastic bags, it can be difficult to remove the holder and install a different type of bag holder when a user wishes to change bagging options provided to customers. Thus, currently available bag holders can be cumbersome, limiting with regard to bagging choices, as well as being time consuming to install, maintain and remove.

SUMMARY

Some examples provide a configurable universal bag holder for accommodating a plurality of bag types. The universal bag holder includes a bag storage receptacle for storing a set of bags. The bag storage receptable includes a first side member mounted to a back portion of a central panel, a back member; and a second side member mounted to the back portion of the central panel. The first side member, the back member, the second side member, and the central panel define a central cavity sized to enclose a set of bags in a folded configuration. A bag rest platform is associated with a front portion of the central panel is sized to support a bottom of a paper bag in an unfolded configuration. A bag support rack is mounted to a front portion of the central panel. The bag support rack includes at least one bag support arm perpendicular to the bag rest platform. An access window within the central panel providing access to the central cavity within the bag storage receptacle.

Other examples provide a method for accommodating a plurality of bag types within a universal bag holder device. The universal bag holder device is attached to a bagging area fixture via an attachment member. A first set of bags associated with a first bag type is stored within a bag storage receptacle. The bag storage receptable includes a first side member, a back member, a second side member and a central panel defining a central cavity sized to enclose the first set of bags in a folded configuration. A second set of bags associated with a second bag type are associated with a bag support rack mounted to a front portion of the central panel. The first bag type of the first set of bags is a different bag type then the second bag type.

Still other examples provide a universal bag holder device including a bag storage receptacle, a bag support rack, and a bag rest platform. The bag storage receptacle includes a first side member, a back member, a second side member, and a central panel defining a central cavity sized to at least partially enclose a first set of bags in a folded configuration. The bag support rack includes a first bag support arm parallel to a second bag support arm. The first bag support arm is spaced a pre-defined distance from the second bag support arm to support a second set of bags supported on the bag support arms or at least one paper bag in an unfolded configuration supported between the first bag support arm and the second bag support arm. The bag rest platform provides a bottom member of the bag storage receptable and extends beneath the bag support rack. The bag rest platform is sized to support a bottom of the at least one paper bag in the unfolded configuration.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

Corresponding reference characters indicate corresponding parts throughout the drawings.

DETAILED DESCRIPTION

A more detailed understanding can be obtained from the following description, presented by way of example, in conjunction with the accompanying drawings. The entities, connections, arrangements, and the like that are depicted in, and in connection with the various figures, are presented by way of example and not by way of limitation. As such, any and all statements or other indications as to what a particular figure depicts, what a particular element or entity in a particular figure is or has, and any and all similar statements, that can in isolation and out of context be read as absolute and therefore limiting, can only properly be read as being constructively preceded by a clause such as "In at least some examples, . . . " For brevity and clarity of presentation, this implied leading clause is not repeated ad nauseam.

Referring to the figures, examples of the disclosure enable a configurable universal bag holder device which is capable of storing and/or displaying multiple types of bags in a single device. In some examples, the universal bag holder device provides a bag holder which can hold plastic bags in a front portion of the bag holder, as well as a storage area in the back portion of the bag holder for storing paper and cloth bags. In this manner, the universal bag holder enables a single bag holder device to provide multiple different types of bags to suit the needs of a given user without removing, installing, or otherwise changing the bag holder device.

In other examples, a universal bag holder device can be installed alone or in combination with one or more other universal bag holder devices on pre-existing bagging area carrousels, bagging area platforms, bagging area tables, self-checkout areas or other fixtures associated with a check-out in a retail environment. In this manner, a user can configure the universal bag holders in any configuration or arrangement suited to the size, shape, and type of bagging area. This increases flexibility and re-usability of bagging fixtures while reducing costs associated with installing the universal bag holder device-reducing network bandwidth usage.

Figure 1:
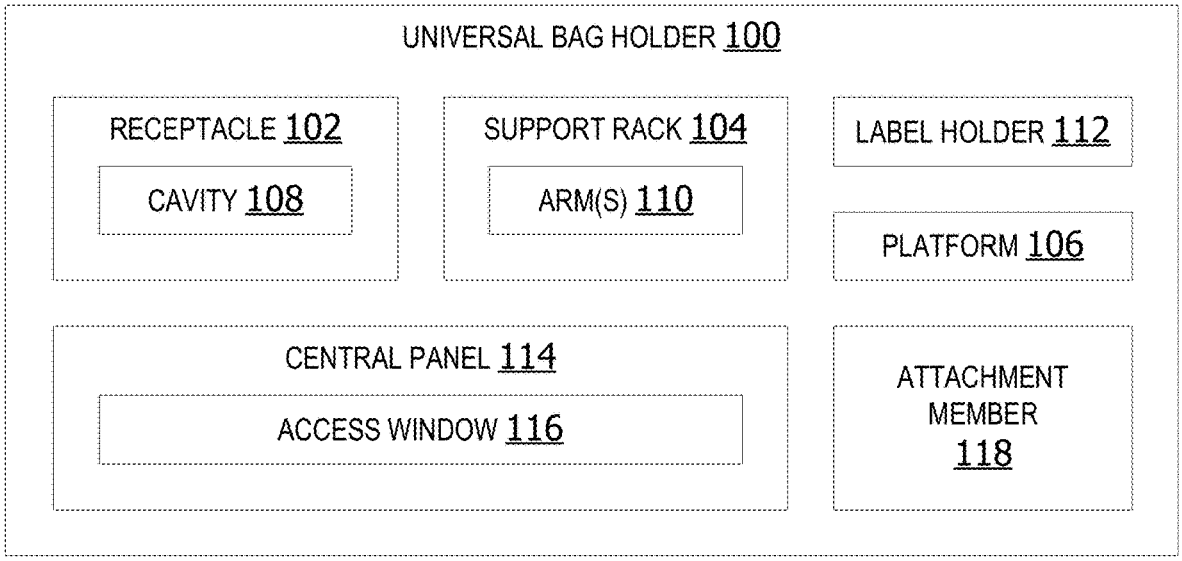
FIG. 1 is an exemplary block diagram illustrating a configurable universal bag holder.

Referring again to FIG. 1, an exemplary block diagram illustrating a configurable universal bag holder 100. The universal bag holder 100 includes a bag storage receptacle 102, a bag support rack 104 and a bag rest platform 106. The bag storage receptacle 102 is a four-sided container having an open top and defining a cavity 108 or other space within the receptacle for storing paper bags in a folded configuration, reusable bags in a folded configuration, and/or boxes in a folded configuration. A bag in a folded configuration is folded flat to minimize an amount of space utilized by the bag. A box in a folded configuration is a box that has been folded flat. A box or bag in a folded configuration is folded such that nothing can be placed inside it.

As used herein, a reusable bag is a bag which is intended for multiple uses rather than a single-use paper or plastic bag. A reusable bag, in some examples, is composed of natural or artificial fibers, such as, but not limited to, cloth.

The bag support rack 104 includes one or more arm(s) 110 for supporting one or more loops on one or more bags placed on the bag support rack 104. In some examples, the bag support rack 104 includes a set of two bag support arms located parallel to each other and perpendicular to the bag rest platform 106.

The bag rest platform 106 forms a bottom member of the bag storage receptacle 102 and extends beneath the one or more arm(s) 110 to provide a platform or base to rest a bottom of a bag during filling of the bag, such as a paper bag or reusable bag. In some examples, a paper bag or reusable bag in an unfolded configuration rests on the bag rest platform and between the pair of bag support arm(s) 110 while a user places one or more items into the unfolded paper or reusable bag.

The universal bag holder 100, in some non-limiting examples, includes a label holder 112. The label holder is a frame, slot, clip, electronic shelf label (ESL), or other label holder for displaying pricing information associated with a bag, information describing a bag or other data associated with a bag in the universal bag holder 100.

A central panel 114 forms one side of the four-sided receptacle 102. The arm(s) 110 attach to a front portion of the central panel 114 while the first side member and the second side member of the universal bag holder 100 attaches to the back portion of the central panel 114. In some examples, the central panel 114 defines an access window 116 providing a portal or other access port into an interior of the bag storage receptacle 102. If a user drops an item into the receptacle 102, the user can retrieve the item from the bottom of the interior cavity 108 of the receptacle by reaching into the cavity 108 via the access window 116. In still other examples, the access window 116 provides an opening through which an interior of the receptacle can be cleaned.

In some examples, the universal bag holder 100 attaches to a bagging area fixture via an attachment member 118. The attachment member 118 can include a set of bolts, screws, clamps, clips, or any other attachment devices.

Figure 2:
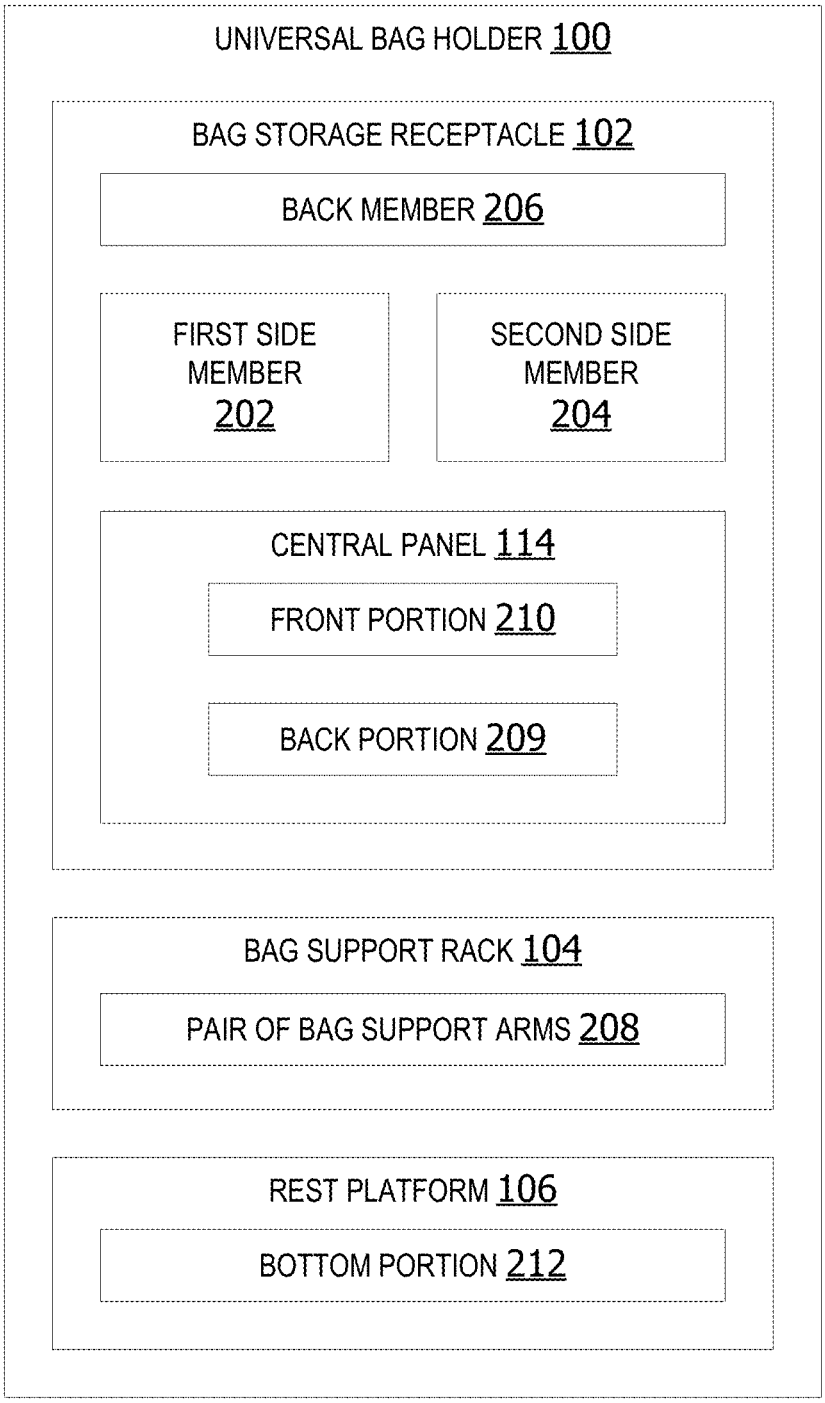
FIG. 2 is an exemplary block diagram illustrating the universal bag holder including a bag storage receptacle, bag support rack and bag rest platform.

FIG. 2 is an exemplary block diagram illustrating the universal bag holder 100 including a bag storage receptacle 102, bag support rack 104 and bag rest platform 106. In some examples, the bag storage receptacle 102 includes a first side member 202 connected to a back portion 209 of the central panel 114 by a first edge. A second edge of a second side member 204 attaches to the back portion 209 of the central panel 114. The first side member 202, the back member 206, the second side member 204 and the central panel 114 forms an open-topped container for storing bags. In some examples, the first side member 202, the second side member 204 and the back member 206 are one contiguous piece which connects to the central panel via the first edge and the second edges of the side members.

A pair of bag support arms 208 attaches to a front portion 210 of the central panel 114. One or more bags with loops or handles can be hung from the pair of bag support arms in a folded/closed configuration or in an open configuration. A paper bag or reusable bag can also be supported between the bag support arms while resting on the bag rest platform 106. In some examples, a back portion of the bag rest platform 106 forms a bottom portion 212 of the bag storage receptacle 102 while a front portion of the bag rest platforms extends beneath the bag support arms 208, such that the bag support arms are positioned parallel to the bag rest platform 106 and perpendicular to the bag storage receptacle. Each bag support arm in the pair of bag support arms 208 are spaced a pre-determined distance apart which is suitable to accommodate the loops on a given type of bag and/or the size of bags being placed on the bag rest platform.

Figure 3:
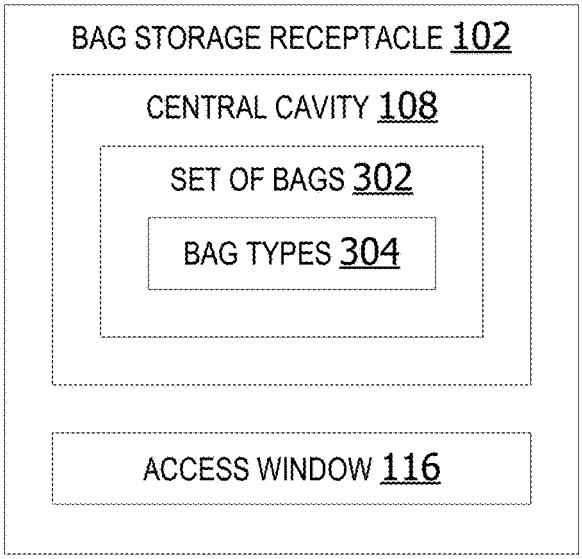
FIG. 3 is an exemplary block diagram illustrating a bag storage receptacle.

FIG. 3 is an exemplary block diagram illustrating a bag storage receptacle 102. In some examples, a set of one or more bags 302 of a given bag type 304 are stored within the central cavity 108 of the bag storage receptacle 102. The bag type of bags stored in the receptacle can include folded paper bags and/or reusable bags. In still other examples, extra plastic bags can be stored within the central cavity 108.

Figure 4:
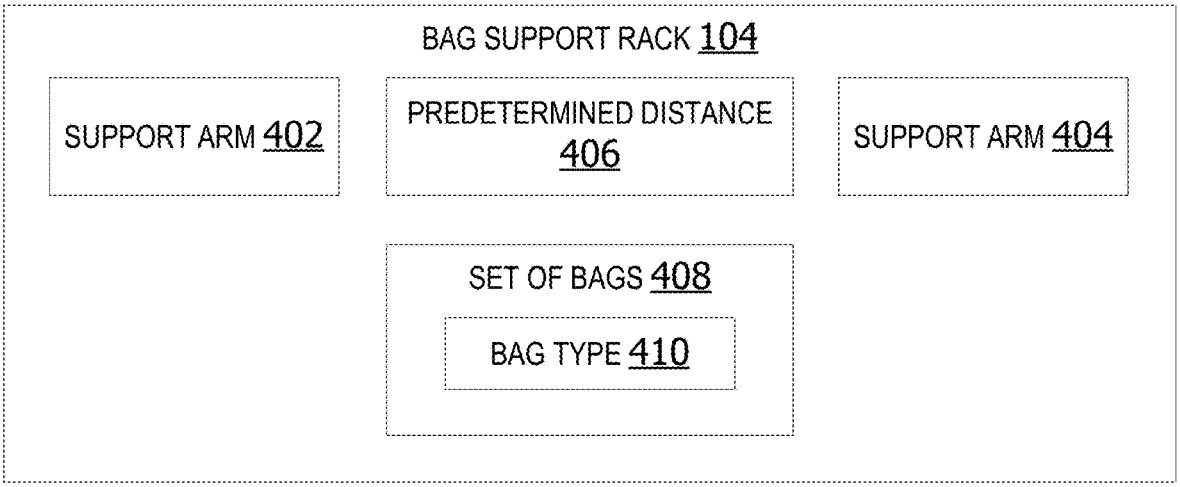
FIG. 4 is an exemplary block diagram illustrating a bag support rack.

FIG. 4 is an exemplary block diagram illustrating a bag support rack 104. In this example, a first support arm 402 and a second support arm 404 are attached to the central panel a pre-determined distance 406 apart. In other words, the arms in a pair of arms are parallel to each other. In other examples, the pair of bag support arms 208 are adjustable such that the height of the arms and the distance between the arms can be adjusted by moving the arms up-and-down or side-to-side on the central panel.

A set of one or more bags 408 of a given bag type 410 can be hung, placed, or otherwise supported on the support arm 402 and/or the support arm 404. In some examples, one or more loops on a bag are placed over the arms to support the arms. The bag type 410, in some examples, includes plastic bags and/or reusable bags having one or more handles or loops.

Figure 5:
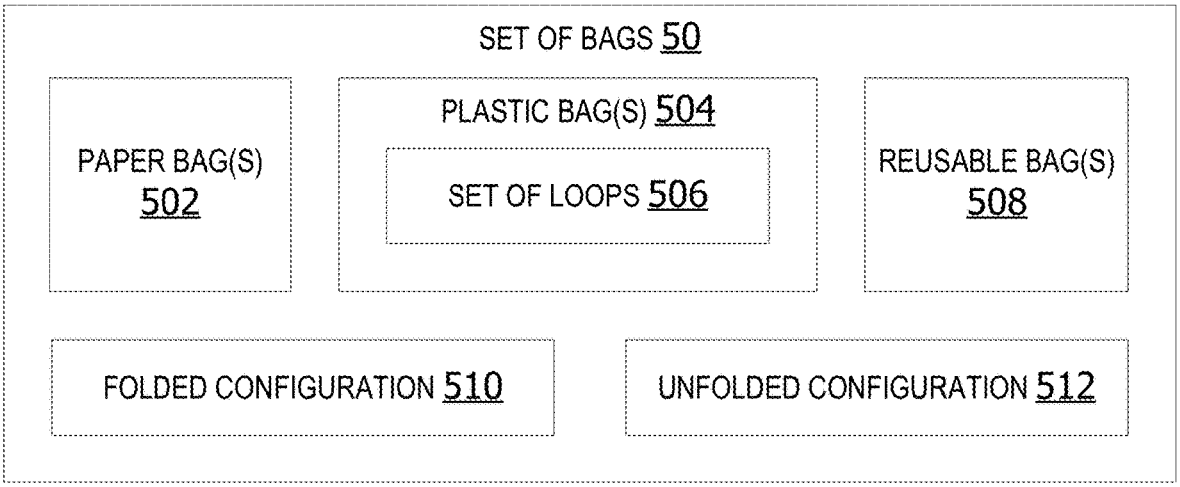
FIG. 5 is an exemplary block diagram illustrating a set of bags.

FIG. 5 is an exemplary block diagram illustrating a set of bags 500. In some examples, the set of bags 500 includes one or more paper bag(s) 502, one or more plastic bag(s) 504, and/or or one or more reusable bag(s) 508. The plastic bag(s) 504 include a set of loops 506. The reusable bag(s) 508 can optionally include one or more loops or handles. The set of bags 500 can be in a folded configuration 510 or an unfolded configuration 512. In some examples, bags in the bag storage receptacle are in a folded configuration. Bags hanging on the arms or resting on the bag rest platform can be in the open/unfolded configuration or the closed/folded configuration.

Figure 6:
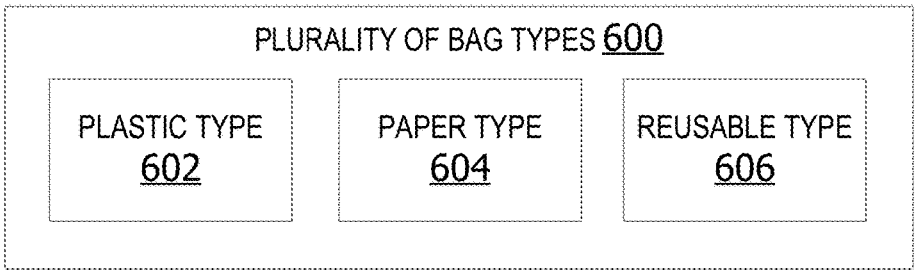
FIG. 6 is an exemplary block diagram illustrating a plurality of bag types.

FIG. 6 is an exemplary block diagram illustrating a plurality of bag types 600. The bag types can include plastic type 602 bags, paper type 604 bags, and/or reusable type 606 bags. In some examples, bags of the paper type are stored in the bag storage receptacle while bags of the plastic type are stored on the bag support rack. Bags of the reusable type can be stored in the bag storage receptacle or stored on the bag support rack. In this manner, the universal bag holder is capable of storing bags of any and all types on a single device.

Figure 7:
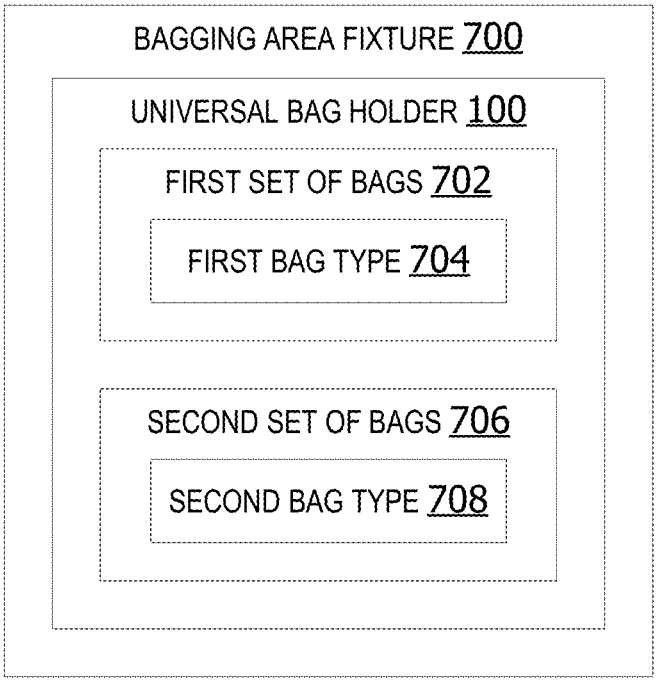
FIG. 7 is an exemplary block diagram illustrating a universal bag holder secured to at least a portion of a bagging area fixture.

FIG. 7 is an exemplary block diagram illustrating a universal bag holder 100 secured to at least a portion of a bagging area fixture 700. The universal bag holder 100 is secured to a portion of a bagging area fixture 700 via an attachment device, such as, but not limited to, bolts, screws, clips, brackets, or other attachment devices. In some non-limiting examples, the universal bag holder 100 stores a first set of bags 702 of a first bag type 704 in the bag storage receptacle and a second set of bags 706 of a second bag type 708 on the bag support rack. In other examples, the universal bag holder 100 can store bags of the same type in the bag storage receptacle and the bag support rack. In still other examples, the universal bag holder 100 can store bags of a first type and bags of a second type within the bag storage receptacle while storing bags of a third type on the bag support rack.

Figure 8:
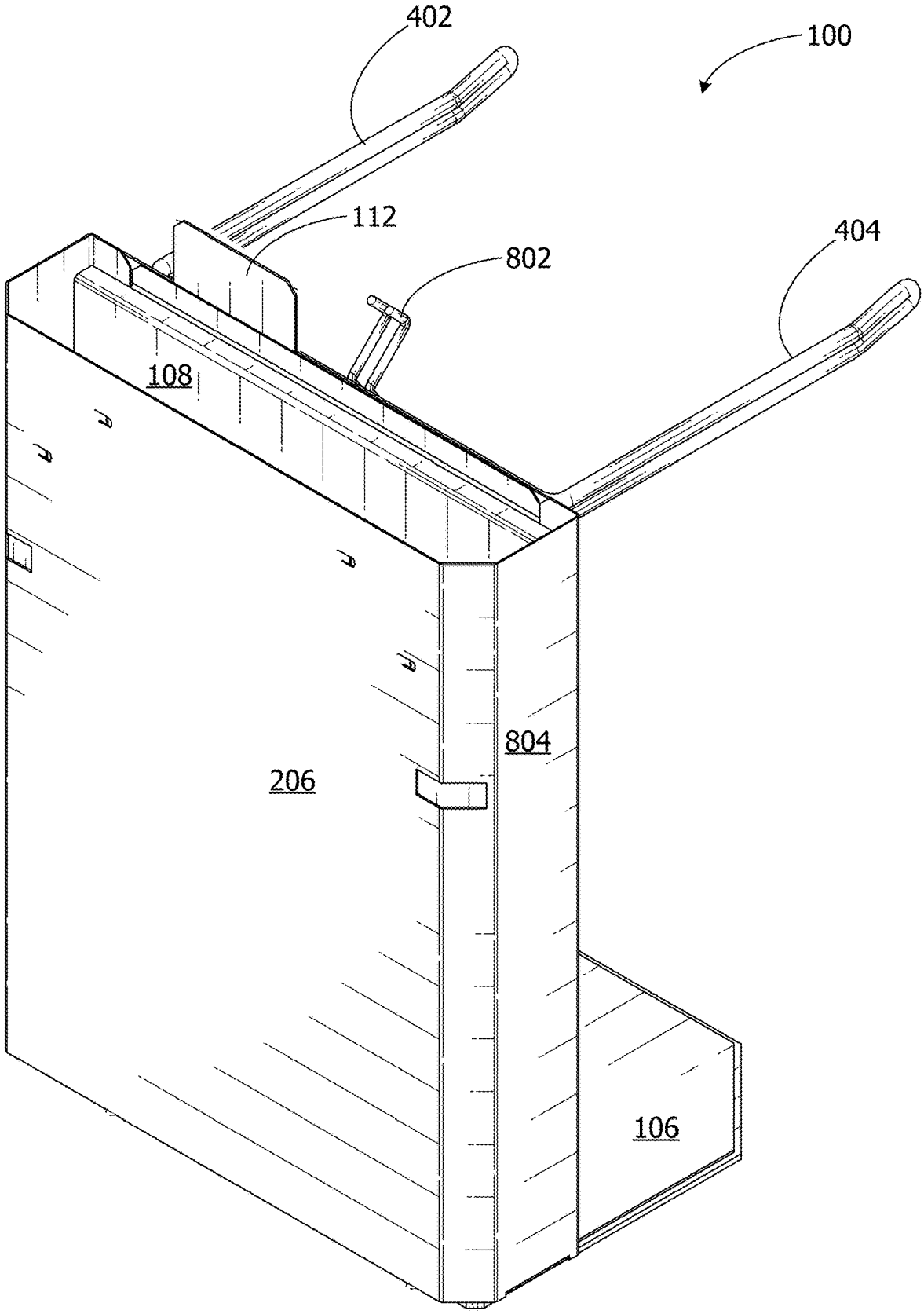
FIG. 8 is an exemplary block diagram illustrating a perspective view of a back of a universal bag holder.

FIG. 8 is an exemplary block diagram illustrating a perspective view of a back of a universal bag holder 100. The universal bag holder 100 includes a back member 206, a side member 804, a second side member and a central panel defining a cavity 108 for storing bags. A label holder 112, in this non-limiting example, is attached to a top portion of the back member 206. In other examples, the label holder is attached to the central panel, one of the side members, or any other portion of the universal bag holder.

A hook 802 is optionally provided between the arm 402 and the arm 404 to provide an additional support on which to hang or attach a portion of a plastic or reusable bag while the bag is in an open configuration on top of or above the platform 106.

Figure 9:
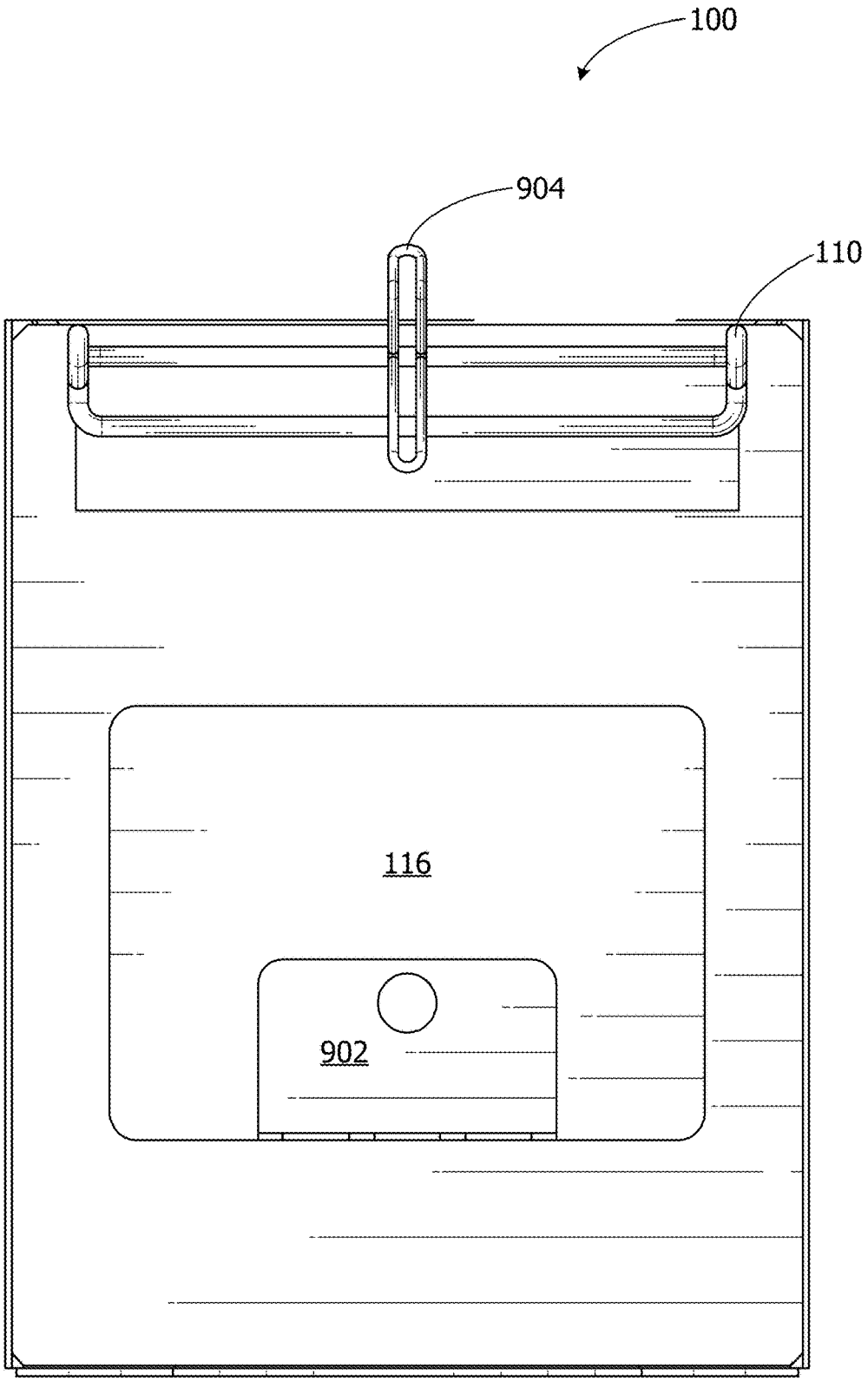
FIG. 9 is an exemplary block diagram illustrating a front view of a universal bag holder.

FIG. 9 is an exemplary block diagram illustrating a front view of a universal bag holder 100. The universal bag holder 100 includes a tab 902 associated with the access window 116. The tab can optionally be bent downward during use of the universal bag holder 100. The universal bag holder 100 in other examples includes the hook 904 between the set of arms 110 for providing additional support to plastic bags.

Figure 10:
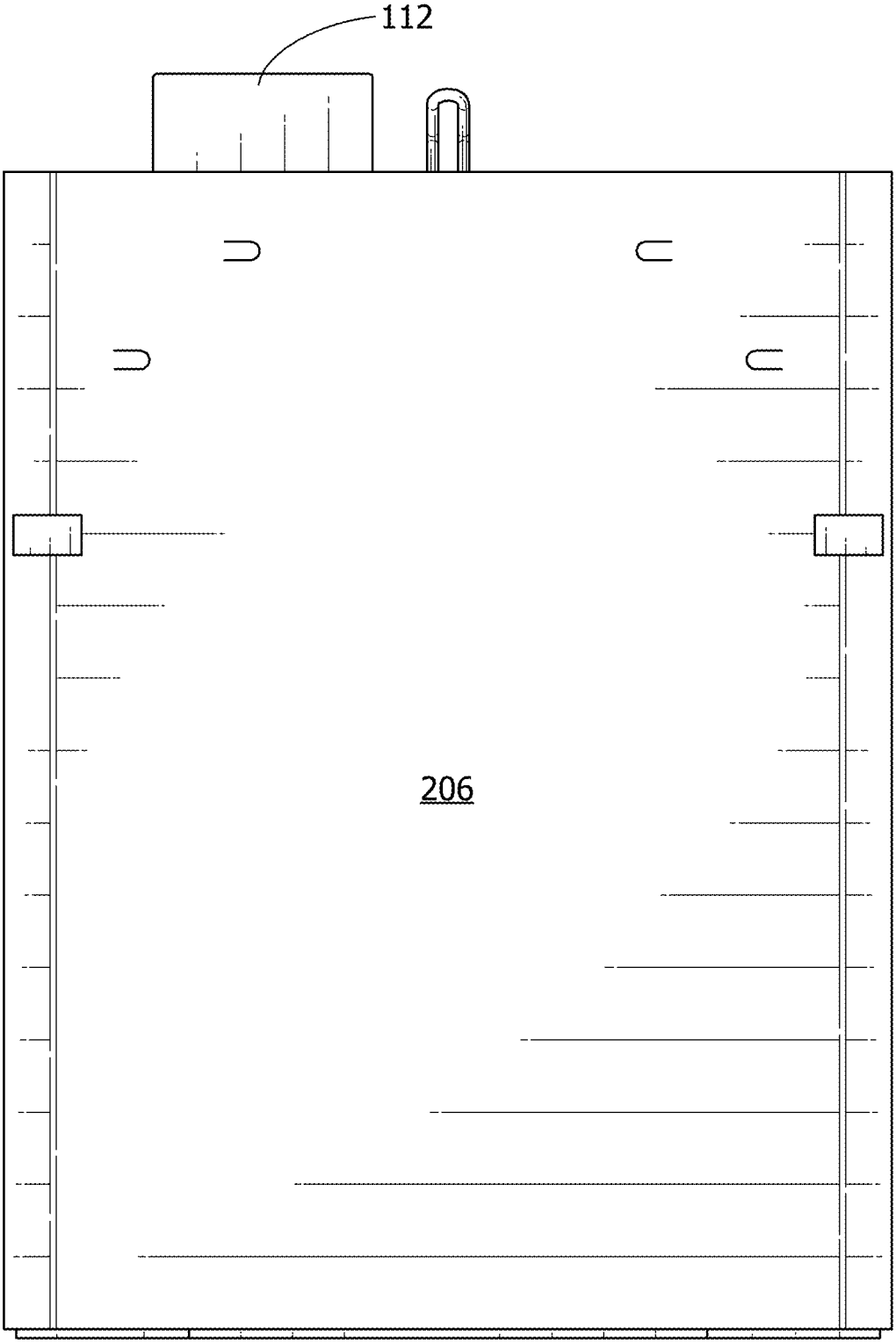
FIG. 10 is an exemplary block diagram illustrating a back view of a universal bag holder.

FIG. 10 is an exemplary block diagram illustrating a back view of a universal bag holder 100. In this non-limiting example, the universal bag holder 100 includes a back member 206 having a label holder 112 attached to a top lip of the back member 206.

Figure 11:
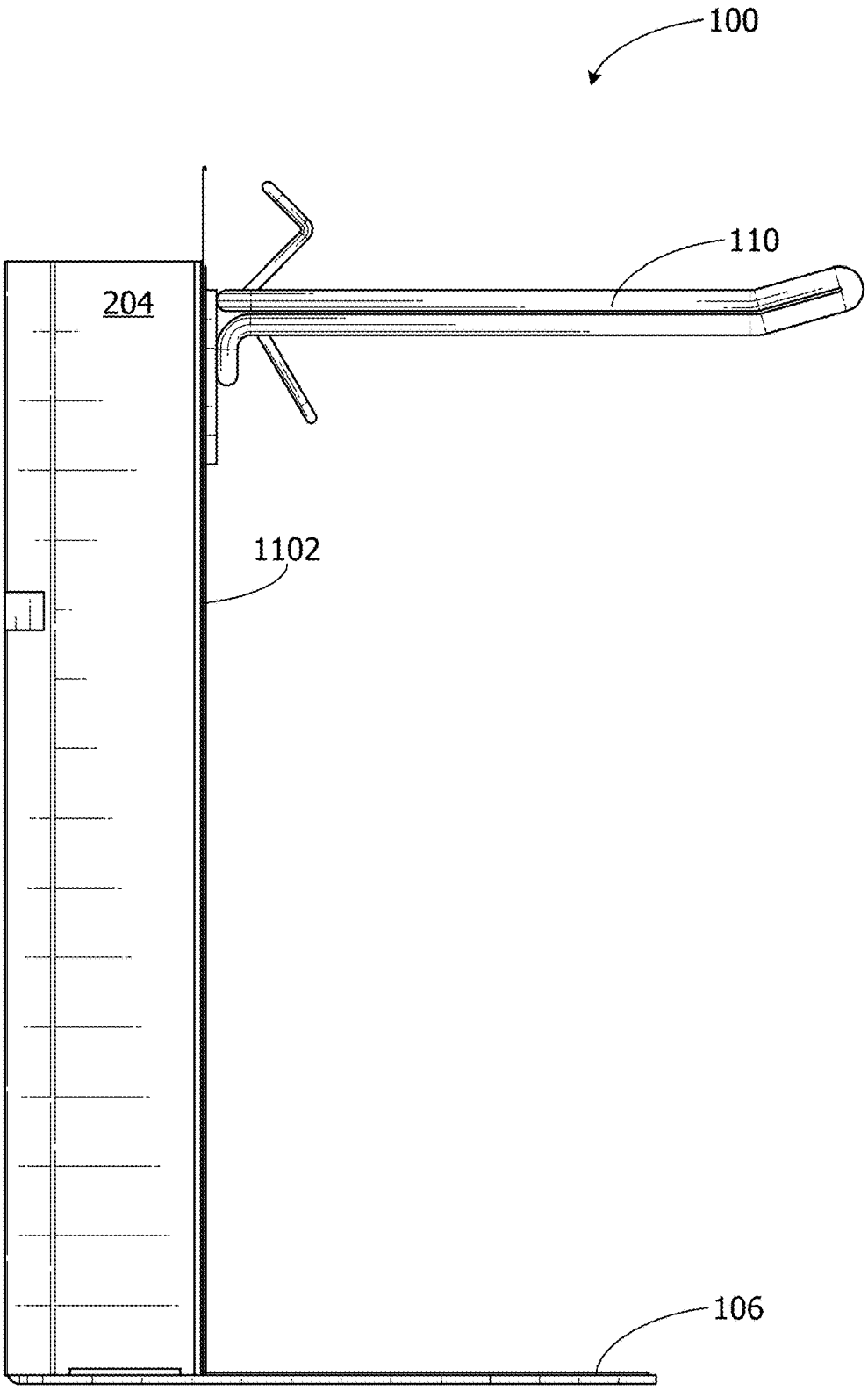
FIG. 11 is an exemplary block diagram illustrating a side view of a universal bag holder.

FIG. 11 is an exemplary block diagram illustrating a side view of a universal bag holder 100. In this non-limiting example, one or more arm(s) 110 are attached to a front portion 1102 of a central panel. An edge or flange on the side member 204 connects to the central panel. A bag rest platform 106 extends under the bag support arm(s) 110.

Figure 12:
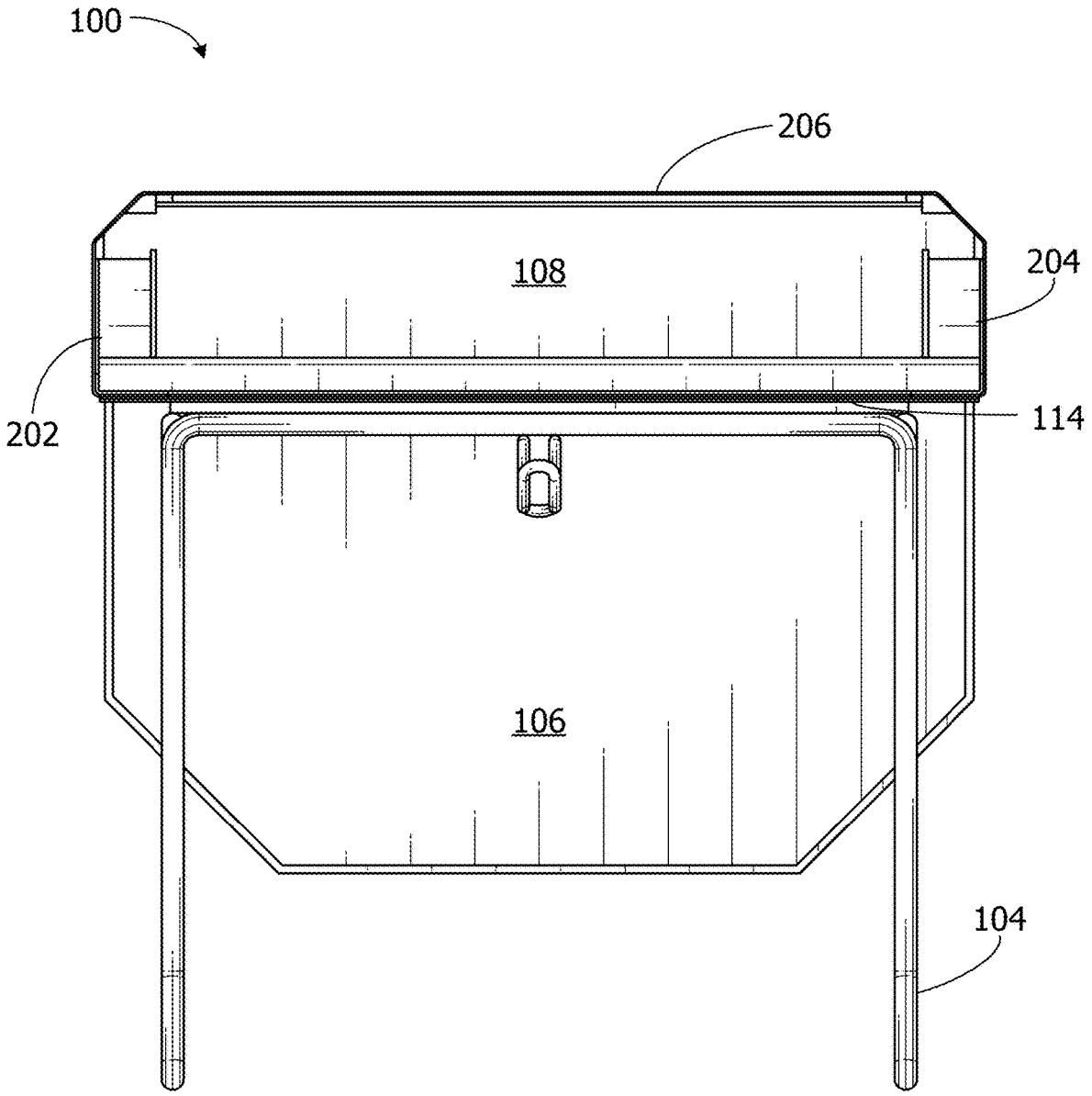
FIG. 12 is an exemplary block diagram illustrating a top view of a universal bag holder.

FIG. 12 is an exemplary block diagram illustrating a top view of a universal bag holder 100. In this non-limiting example, the central panel 114, the first side member 202, the back member 206 and the second side member 204 define a cavity 108, within which, bags are stored. A bag rest platform 106 extends beneath the bag support rack 104 to support bags while in an unfolded configuration.

Figure 13:
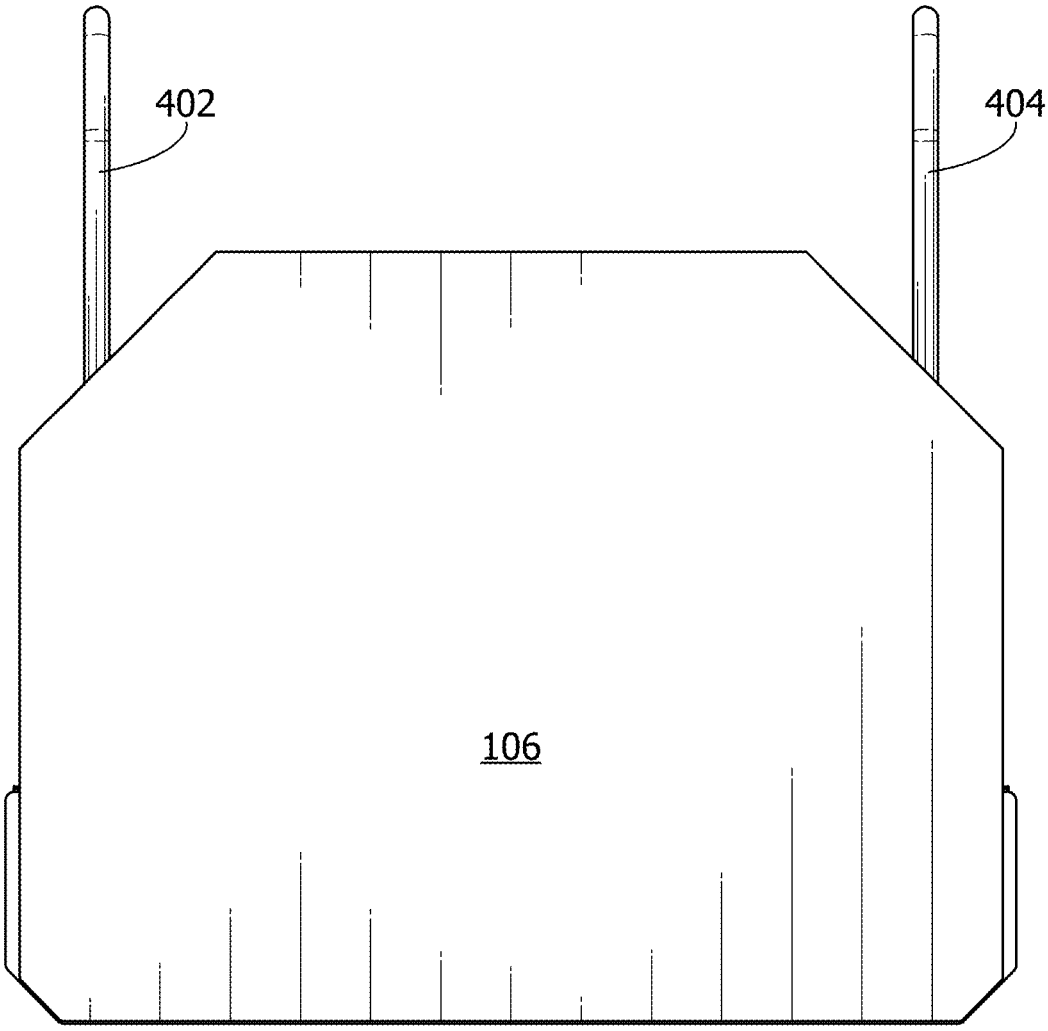
FIG. 13 is an exemplary block diagram illustrating a bottom view of a universal bag holder.

FIG. 13 is an exemplary block diagram illustrating a bottom view of a universal bag holder 100. In this non-limiting example, a bottom of a bag rest platform 106 is shown. A bag support arm 402 is parallel to another bag support arm 404 for support one or more bags on the bag support rack.

Figure 14:
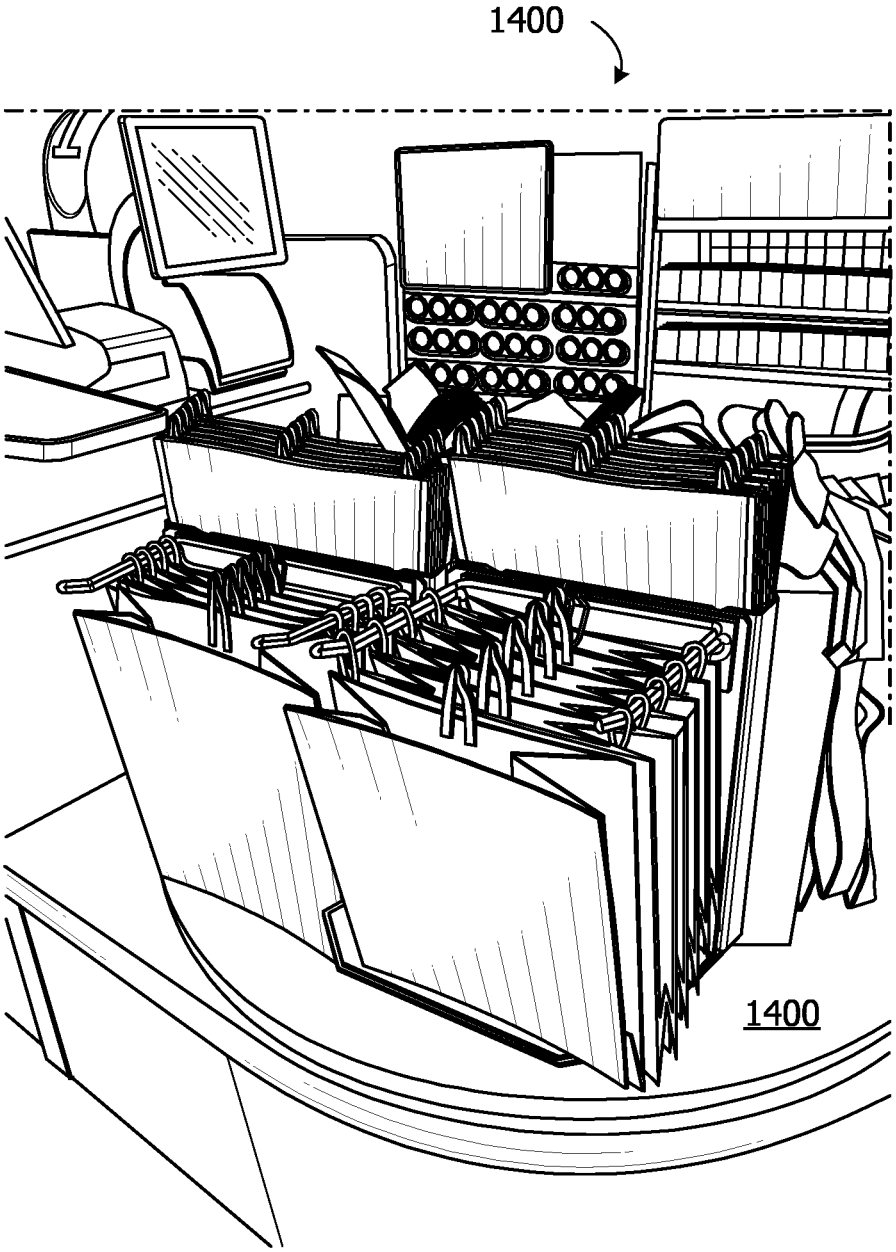
FIG. 14 is an exemplary block diagram illustrating a set of two universal bag holders on a bagging area fixture.

FIG. 14 is an exemplary block diagram illustrating a set of two universal bag holders 1400 on a bagging area fixture 1402. In this non-limiting example, each universal bag holder includes a set of reusable bags within the bag storage receptacle and a set of reusable bags on the bag support rack.

Figure 15:
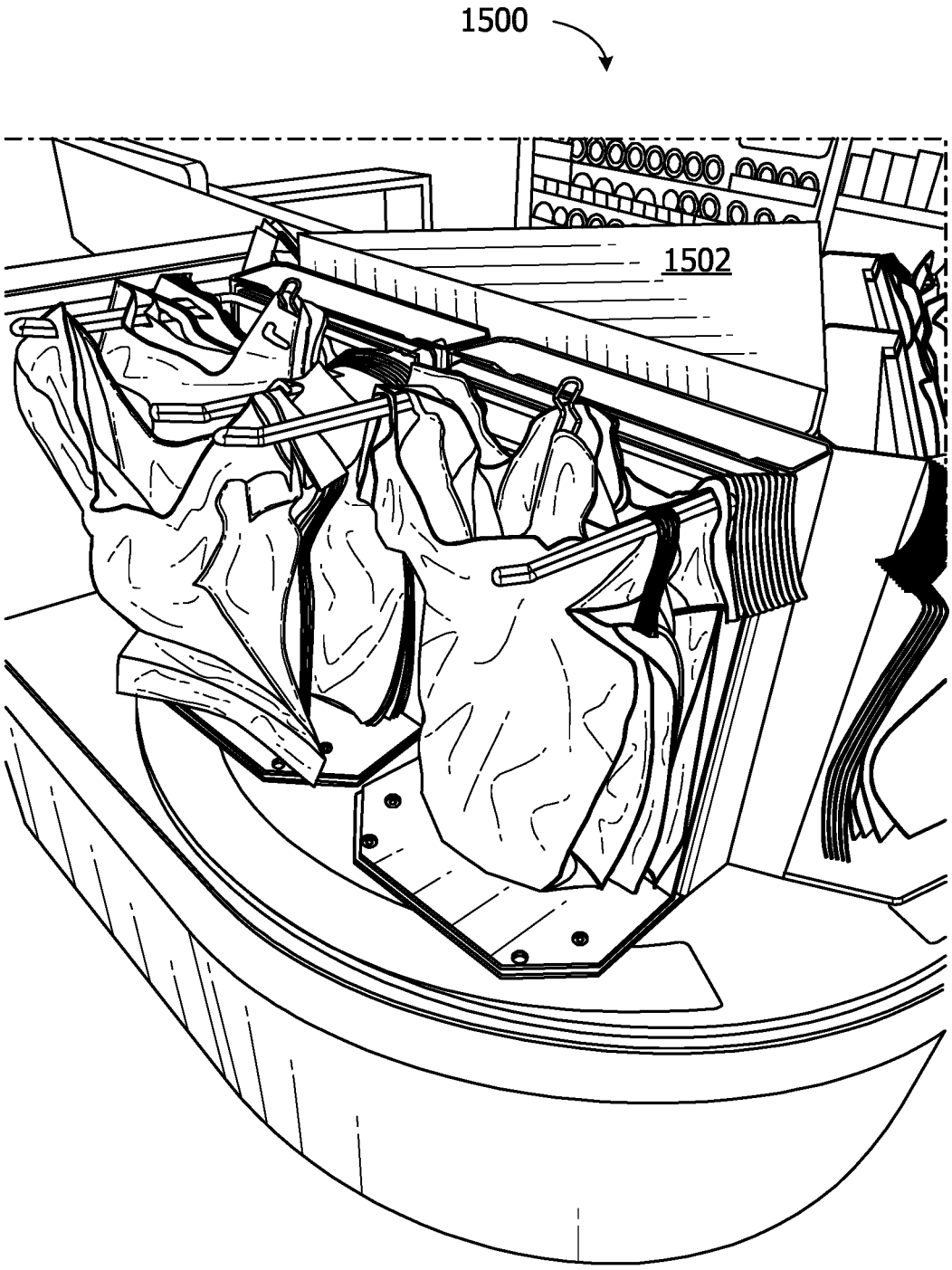
FIG. 15 is an exemplary block diagram illustrating a set of four universal bag holders on a bagging fixture.

FIG. 15 is an exemplary block diagram illustrating a set of four universal bag holders 1500 on a bagging fixture 1502. In this example, plastic bags are placed on the bag support racks. The bag storage receptacle of each universal bag holder is empty in this non-limiting example.

Figure 16:
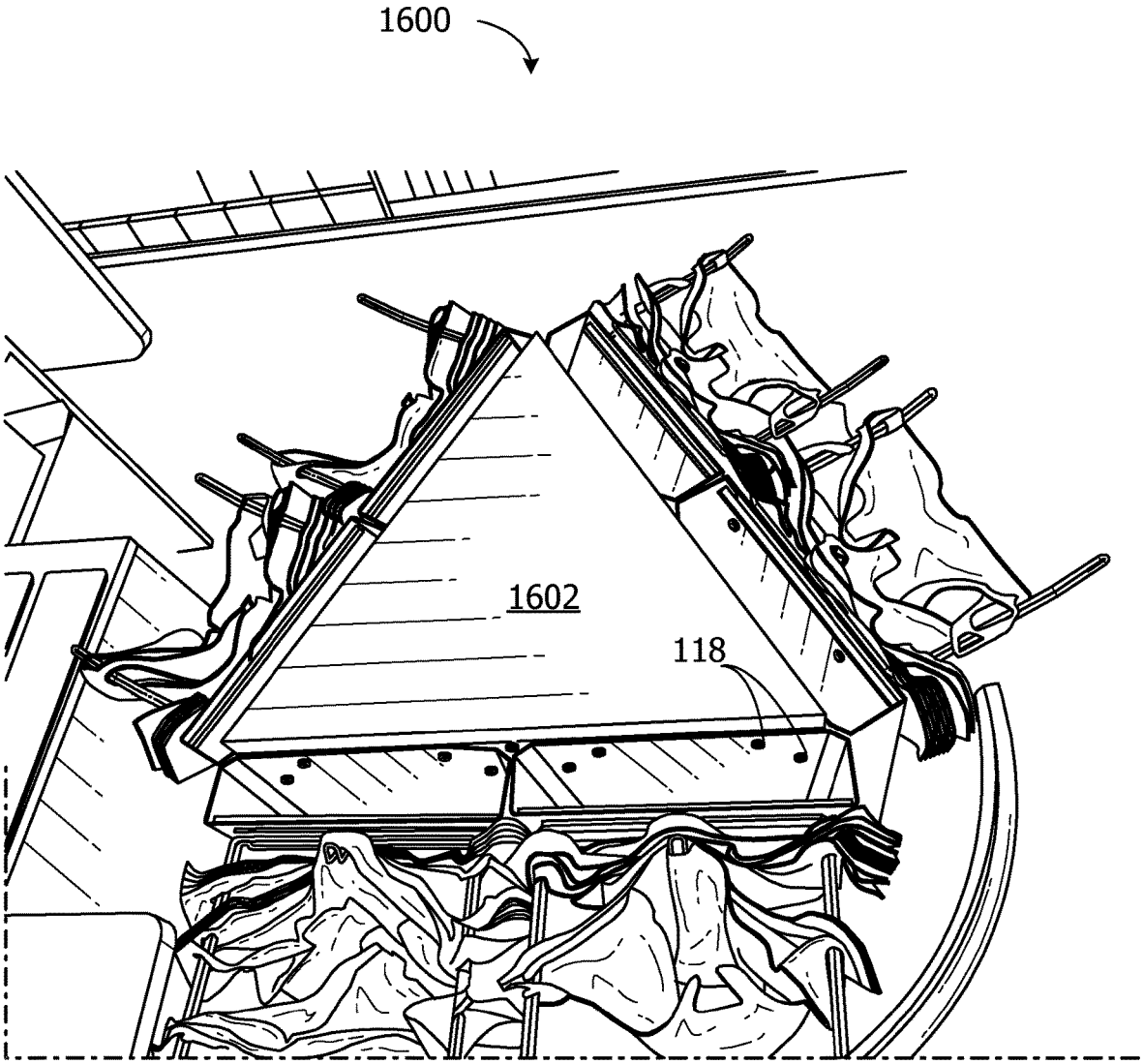
FIG. 16 is an exemplary block diagram illustrating a top view of six universal bag holders on a bagging area fixture.

FIG. 16 is an exemplary block diagram illustrating a top view of a set of six universal bag holders 1600 on a bagging area fixture 1602. In this example, plastic bags are supported on the bag support racks of each universal bag holder on a bagging carrousel.

Figure 17:
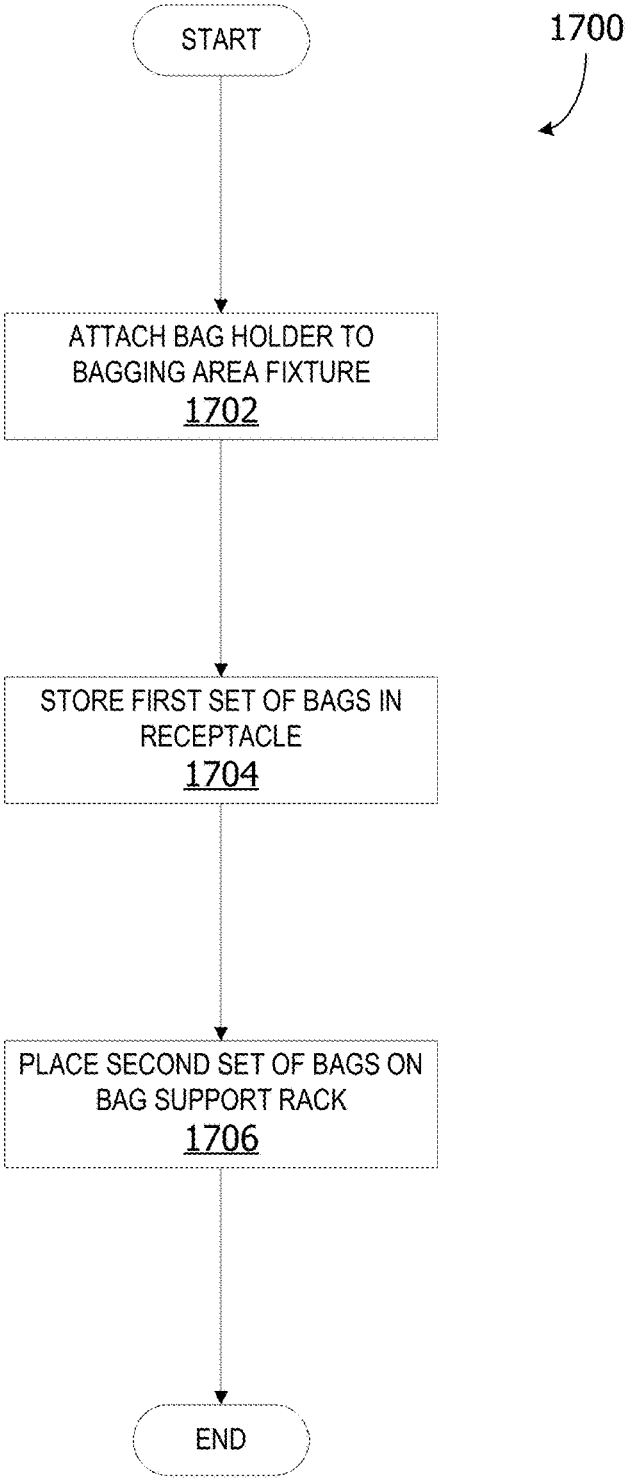
FIG. 17 is an exemplary flow chart illustrating a process for providing a plurality of types of bags on a configurable universal bag holder.

FIG. 17 is an exemplary flow chart 1700 illustrating a process for providing a plurality of types of bags on a configurable universal bag holder. The process begins by attaching a universal bag holder to a bagging area fixture at 1702. A first set of bags are stored in a bag storage receptacle at 1704. A second set of bags are placed on a bag support rack at 1706. The bags in the receptacle are the same type of bags as the bags on the rack in some examples. In other examples, the bags in the receptacle are a different type of bag than the type of bags placed on the bag support rack. The process terminates thereafter.

Figure 18:
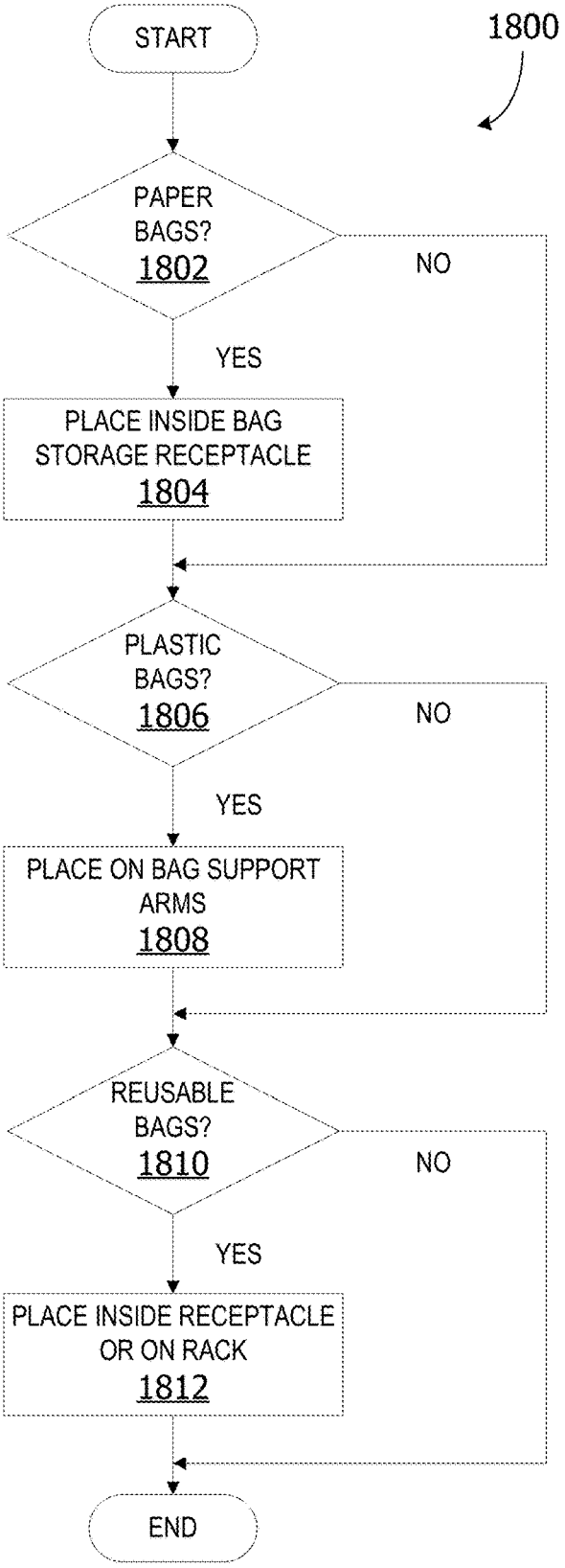
FIG. 18 is an exemplary flow chart illustrating a process for placing different types of bags on a universal bag holder.

FIG. 18 is an exemplary flow chart 1800 illustrating a process for placing different types of bags on a universal bag holder. A determination is made whether one or more paper bags are being placed on the universal bag holder at 1802. If yes, the paper bags are placed within the bag storage receptacle at 1804. A determination is made whether one or more plastic bags are being placed in the universal bag holder at 1806. If yes, the plastic bag(s) are placed on the bag support arms of the bag support rack at 1908. A determination is made whether to place reusable bags on the universal bag holder at 1910. If yes, the reusable bags are placed inside the bag storage receptacle or on the bag support rack at 1812. The reusable bags can either be placed in the receptacle or on the rack. In other examples, the reusable bags are placed in the receptacle and on the rack. The process terminates thereafter.

Additional Examples

In some examples, a universal bag holder is provided for as a solution to changing requirements for bags and trends involving plastic, paper, and reusable bag options. The universal bag holder that accommodates paper, plastic and reusable bags and allows for reconfiguration by users as the types of bags provided for bagging items changes. The bag holder includes a bag holder having a receptacle for storing bags. The bag holder encloses/contains paper bags or reusable cloth bag. The receptacle can be four sides and a bottom with an open top.

In other examples, a pair of bag support arms (bag rack) are attached to a front side of the bag holder. The bag support arms can support one or more cloth bags. The bag support arms can support multiple plastic bags. A Paper bag in an open configuration (unfolded to receive groceries during bagging) fits between the support arms.

In other examples, a bag rest platform attaches to the front side of the bag holder below the bag support arms. The paper bag or cloth bag rests on the platform. A window in the front side of the bag holder enables access to interior of bag holder. This permits retrieval of items which may fall into the bag holder/cleaning.

An attachment member is provided in other examples for attaching the bag holder to a bag carousel, bagging area rail, wall, or other fixture. A label holder is provided for attaching price tags/displaying price of paper or reusable bags available within the receptacle.

The universal bag holder stores paper or reusable bags inside a receptacle. The universal bag holder arms can hold cloth or plastic bags. A platform is provided for placement of an unfolded paper bag or unfolded cloth bag between the arms. The bag holder can be attached to existing fixtures for bagging holders.

Alternatively, or in addition to the other examples described herein, examples include any combination of the following:

- a bag storage receptacle for storing a set of bags, the bag storage receptable comprising a first side member mounted to a back portion of a central panel, a back member and a second side member mounted to the back portion of the central panel;
- the first side member, the back member, the second side member, and the central panel defining a central cavity sized to enclose a set of bags in a folded configuration;
- a bag rest platform mounted to a bottom edge of a front portion of the central panel, the bag rest platform sized to support a bottom of a paper bag in an unfolded configuration;
- a bag support rack mounted to a front portion of the central panel, the bag support rack comprising at least one bag support arm perpendicular to the bag rest platform;
- an access window within the central panel providing access to the central cavity within the bag storage receptacle;
- an access window within the central panel enabling access to the central cavity of the bag storage receptable;
- the set of bags in a folded configuration comprises at least one of a set of folded paper bags or a set of folded reusable bags;
- the set of bag support arms are spaced a pre-defined distance apart to support a set of loops on at least one bag, wherein the at least one bag comprises at least one plastic bag or at least one reusable bag;
- the set of bag support arms are spaced a pre-defined distance apart to support a paper bag in an unfolded configuration between the first bag support arm and the second bag support arm;
- a label holder attached to a top portion of the central panel;
- an attachment member for attaching the universal bag holder to a bagging area fixture;
- a first set of bags of a first bag type stored within the bag storage receptable;
- a second set of bags of a second bag type stored on the bag support rack, wherein the first bag type of the first set of bags is a different bag type then the second bag type;
- attaching, via an attachment member, the universal bag holder device to a bagging area fixture;
- storing a first set of bags associated with a first bag type within a bag storage receptacle, the bag storage receptable comprising a first side member, a back member, a second side member and a central panel defining a central cavity sized to enclose the first set of bags in a folded configuration;
- placing, on a bag support rack mounted to a central panel of the central panel, a second set of bags associated with a second bag type, the bag support rack comprising a set of bag support arms perpendicular to a bag rest platform, the set of bag support arms comprising a first bag support arm parallel to a second bag support arm, wherein the first bag type of the first set of bags is a different bag type then the second bag type;
- placing a paper bag in an unfolded configuration on the bag rest platform, wherein a bottom of the paper bag is supported by the bag rest platform, and wherein the paper bag is supported between the first bag support arm and the second bag support arm;
- accessing the central cavity via an access window within the central panel;
- the first set of bags of the first bag type comprises a set of folded paper bags of a paper bag type or a set of folded reusable bags of a reusable bag type and the second set of bags of the second bag type comprises a set of plastic bags of a plastic bag type or a set of reusable bags of a reusable bag type;
- presenting, via a label holder attached to a top portion of the central panel, information associated with at least one type of bag stored in the bag storage receptable or placed on the bag support rack;
- removing an item from within the bag storage receptacle via an access window;
- cleaning an interior of the bag storage receptacle via an access window associated with the central panel;
- a bag storage receptacle comprising a first side member, a back member, a second side member, and a central panel defining a central cavity sized to at least partially enclose a first set of bags in a folded configuration;
- a bag support rack associated with a front portion of the central panel, the bag support rack comprising a first bag support arm parallel to a second bag support arm, the first bag support arm spaced a pre-defined distance from the second bag support arm to support a second set of bags supported on the bag support arms or at least one paper bag in an unfolded configuration supported between the first bag support arm and the second bag support arm;

a bag rest platform forming a bottom member of the bag storage receptable and extending beneath the bag support rack, the bag rest platform sized to support a bottom of the at least one paper bag in the unfolded configuration;

an access window within the central panel providing access to the interior cavity within the bag storage receptacle;

a label holder attached to a top portion of the central panel; and a removable lid sized to fit across a top of the bag storage receptacle.

While the aspects of the disclosure have been described in terms of various examples with their associated operations, a person skilled in the art would appreciate that a combination of operations from any number of different examples is also within scope of the aspects of the disclosure.

The order of execution or performance of the operations in examples of the disclosure illustrated and described herein is not essential, unless otherwise specified. That is, the operations can be performed in any order, unless otherwise specified, and examples of the disclosure can include additional or fewer operations than those disclosed herein. For example, it is contemplated that executing or performing an operation before, contemporaneously with, or after another operation is within the scope of aspects of the disclosure.

The indefinite articles "a" and "an," as used in the specification and in the claims, unless clearly indicated to the contrary, should be understood to mean "at least one." The phrase "and/or," as used in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used in the specification and in the claims, "or" should be understood to have the same meaning as "and/or" as defined above. For example, when separating items in a list, "or" or "and/or" shall be interpreted as being inclusive, i.e., the inclusion of at least one, but also including more than one of a number or list of elements, and, optionally, additional unlisted items. Only terms clearly indicated to the contrary, such as "only one of or "exactly one of," or, when used in the claims, "consisting of" will refer to the inclusion of exactly one element of a number or list of elements. In general, the term "or" as used shall only be interpreted as indicating exclusive alternatives (i.e., "one or the other but not both") when preceded by terms of exclusivity, such as "either", "one of", "only one of", or "exactly one of" "Consisting essentially of," when used in the claims, shall have its ordinary meaning as used in the field of patent law.

As used in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

The use of "including," "comprising," "having," "containing," "involving," and variations thereof, is meant to encompass the items listed thereafter and additional items.

Use of ordinal terms such as "first," "second," "third," etc., in the claims to modify a claim element does not by itself connote any priority, precedence, or order of one claim element over another or the temporal order in which acts of a method are performed. Ordinal terms are used merely as labels to distinguish one claim element having a certain name from another element having a same name (but for use of the ordinal term), to distinguish the claim elements.

Having described aspects of the disclosure in detail, it will be apparent that modifications and variations are possible without departing from the scope of aspects of the disclosure as defined in the appended claims. As various changes could be made in the above constructions, products, and methods without departing from the scope of aspects of the disclosure, it is intended that all matter contained in the above description and shown in the accompanying drawings shall be interpreted as illustrative and not in a limiting sense.

What is claimed is:

1. A universal bag holder comprising:

a bag storage container for storing a set of bags, the bag storage container comprising:

a central panel having an access window disposed towards a bottom portion of the central panel;

a first side member attached to a first side edge of a back portion of the central panel;

a second side member attached to a second side edge of the back portion of the central panel, the second side member disposed opposite the first side member;

a back member attached to the first side member and the second side member so as to define an open-topped central cavity, wherein the open-topped central cavity forms the bag storage container for storing the set of bags; and a bag rest platform mounted to a bottom edge of the central panel, the bag rest platform extending away from a front portion of the central panel and sized to support a bottom of a bag in an open configuration; and a bag support rack mounted to the front portion of the central panel, the bag support rack comprising a first bag support arm and a second bag support arm parallel to the first bag support arm, the first bag support arm and the second bag support arm extending linearly away from the front portion of the central panel.

2. The universal bag holder of claim 1 wherein the access window disposed towards the bottom portion of the central panel provides secondary access to the open-topped central cavity.

3. The universal bag holder of claim 1, wherein the first bag support arm is spaced at a distance relative to the second bag support arm to accommodate at least one of loops or handles of a given bag.

4. The universal bag holder of claim 1, further comprising:

a label holder attached to a top portion of the central panel.

5. The universal bag holder of claim 1, further comprising:

a label holder attached to a top portion of the back member.

6. The universal bag holder of claim 1, further comprising:

an attachment member for attaching the universal bag holder to a bagging area fixture.

7. The universal bag holder of claim 1, wherein the set of bags comprises:

a first set of bags of a first bag type stored within the bag storage container; and a second set of bags of a second bag type stored on the bag support rack, wherein the first bag type is different than the second bag type.

8. An apparatus comprising:

an open-topped container defined by a first side panel, a back panel, a second side panel, and a central panel, wherein the first side panel attaches at a first side edge of the first side panel to a first side edge of the back panel, the second side panel attaches at a first side edge of the second side panel to a second side edge of the back panel, and the central panel attaches at a first side edge of the central panel to a second side edge of the first side panel and at a second side edge of the central panel to a second side edge of the second side panel, and wherein an interior face of the central panel faces an interior face of the back panel;

a bag support rack attached to an exterior face of the central panel, the bag support rack comprising a first bag support arm parallel to a second bag support arm, the first bag support arm spaced a pre-defined distance from the second bag support arm to support a bag in an unfolded configuration between the first bag support arm and the second bag support arm; and a bag rest platform extending from a bottom of the open-topped container in a direction parallel to the first bag support arm and the second bag support arm, the bag rest platform configured to support a bottom of the bag in the unfolded configuration.

9. The apparatus of claim 8, further comprising:

an access window disposed along the central panel and providing secondary access to the interior of the open-topped container.

10. The apparatus of claim 8, further comprising:

a label holder attached to a top portion of the central panel.

11. The apparatus of claim 8, further comprising:

an attachment member for attaching the apparatus to a bagging area fixture.

12. The apparatus of claim 8, further comprising:

a label holder attached to a top portion of the back panel.

13. The apparatus of claim 8, wherein the bag support rack further comprises:

a hook disposed between the first bag support arm and the second bag support arm, wherein the hook provides additional support for the bag in the unfolded configuration.

14. A universal bag holder comprising:

a bag storage receptacle comprising:

a central panel;

a first side member attached at a first side edge of the first side member to a first side edge of the central panel;

a second side member attached at a first side edge of the second side member to a second side edge of the central panel, the second side member facing opposite the first side member;

a back member attached at a first side edge of the back member to a second side edge of the first side member and at a second side edge of the back member to a second side edge of the second side member, wherein the central panel, the first side member, the second side member, and the back member define an open-topped central cavity of the bag storage receptacle;

a bag rest platform, wherein a portion of the bag rest platform forms a bottom panel of the open-topped central cavity and another portion of the bag rest platform extends out from a bottom edge of the central panel in a direction perpendicular to the open-topped central cavity; and a bag support rack affixed to an exterior, upper portion of the central panel relative to the open-topped central cavity, the bag support rack comprising a first support arm and a second support arm parallel to the first support arm, the first support arm and the second support arm extending linearly away from the exterior, upper portion of the central panel relative to the open-topped central cavity.

15. The universal bag holder of claim 14, further comprising:

an access window disposed along the central panel and providing secondary access to the interior of the open-topped central cavity.

16. The universal bag holder of claim 14, further comprising:

a label holder attached to a top portion of the central panel.

17. The universal bag holder of claim 14, further comprising:

a label holder attached to a top portion of the back member.

18. The universal bag holder of claim 14, further comprising:

an attachment member for attaching the bag storage receptacle to a bagging area fixture.

19. The universal bag holder of claim 14, further comprising:

a hook disposed between the first support arm and the second support arm, wherein the hook provides additional support for a bag in an unfolded configuration.

* * * * *